US008872705B2

(12) United States Patent
Wong et al.

(10) Patent No.: US 8,872,705 B2
(45) Date of Patent: Oct. 28, 2014

(54) DUAL-BAND MOBILE COMMUNICATION DEVICE HAVING AN ANTENNA STRUCTURE INTEGRATED WITH A COUPLING FEED THEREOF

(75) Inventors: Kin-Lu Wong, Taipei Hsien (TW); Wei-Yu Chen, Taipei Hsien (TW)

(73) Assignee: Acer Inc., Taipei Hsien (TW)

( * ) Notice: Subject to any disclaimer, the term of this patent is extended or adjusted under 35 U.S.C. 154(b) by 408 days.

(21) Appl. No.: 12/851,588

(22) Filed: Aug. 6, 2010

(65) Prior Publication Data

US 2011/0267237 A1 Nov. 3, 2011

(30) Foreign Application Priority Data

May 3, 2010 (TW) ..... 99114095 A

(51) Int. Cl.

| | |
|---|---|
| ***H01Q 1/24*** | (2006.01) |
| ***H01Q 1/36*** | (2006.01) |
| ***H01Q 9/42*** | (2006.01) |
| ***H01Q 5/00*** | (2006.01) |
| ***H01Q 1/38*** | (2006.01) |

(52) U.S. Cl.

CPC . *H01Q 9/42* (2013.01); *H01Q 1/36* (2013.01); *H01Q 5/0062* (2013.01); *H01Q 1/38* (2013.01)

USPC ..... 343/702; 741/700 MS; 741/848

(58) Field of Classification Search

USPC ..... 343/702, 700 MS, 741, 848

See application file for complete search history.

(56) References Cited

U.S. PATENT DOCUMENTS

| | | | | |
|---|---|---|---|---|
| 6,252,552 | B1 | 6/2001 | Tarvas et al. | |
| 2007/0069958 | A1 | 3/2007 | Ozkar | |
| 2007/0285321 | A1 | 12/2007 | Chung et al. | |
| 2008/0180333 | A1 * | 7/2008 | Martiskainen et al. ..... | 343/722 |
| 2009/0273521 | A1 | 11/2009 | Wong et al. | |

FOREIGN PATENT DOCUMENTS

| | | | |
|---|---|---|---|
| CN | 2796147 | Y | 7/2006 |
| CN | 201397882 | Y | 2/2010 |
| TW | I227576 | B | 2/2005 |
| TW | 200832814 | A | 8/2008 |

* cited by examiner

*Primary Examiner* — Douglas W Owens
*Assistant Examiner* — Jae Kim
(74) *Attorney, Agent, or Firm* — Alan Kamrath; Kamrath IP Lawfirm, P.A.

(57) ABSTRACT

A dual-band mobile communication device includes a ground plane and an antenna located on a dielectric substrate and including a feeding portion and a shorted radiating portion. One end of the feeding portion is a feeding point of the antenna. A length of the shorted radiating portion is at least twice that of the feeding portion. A first end of the shorted radiating portion, electrically connected to the ground plane, is a shorting end, and the second end of the shorted radiating portion is an open end. The shorted radiating portion includes multiple bendings which form multiple fractional sections. The open end of the shorted radiating portion extends toward a first fractional section of the shorting end of the shorted radiating portion. A coupling gap exists between a second fractional section of the open end of the shorted radiating portion and the feeding portion.

13 Claims, 4 Drawing Sheets

DUAL-BAND MOBILE COMMUNICATION DEVICE HAVING AN ANTENNA STRUCTURE INTEGRATED WITH A COUPLING FEED THEREOF

BACKGROUND OF THE INVENTION

1. Field of the Invention

The present invention relates to a mobile communication device and an antenna structure and, especially, to a dual-band mobile communication device and an antenna structure that is applicable to the wireless wide area network (WWAN) operation.

2. Description of the Related Art

Currently, most of the mobile communication devices use the GSM (Global System for Mobile Communication) system, but a third-generation mobile communication system, UMTS, (Universal Mobile Telecommunication System) has also gained popularity among users. Therefore, it is essential for the antenna of a mobile communication device to cover both the GSM and UMTS bands.

In order to cover the operating bands of 824~960 MHz and 1710~2170 MHz, the traditional antenna usually occupies a large space inside the mobile communication device. In the prior technology, the coupling feed is used to reduce the antenna size and still maintain the multiband operation of the antenna.

However, the arrangement of the traditional antenna with a coupling feed usually cannot effectively reduce the length of the antenna along an edge of a mobile communication device. Hence, the occupied area of the antenna cannot be further reduced. For example, a coupling feed method for a multi-band mobile communication device is disclosed by Taiwan Patent NO. I295517. The internal multiband antenna disclosed by this patent covers four operating bands of GSM900/1800/1900/UMTS. However, with this traditional coupling feed method, it is difficult to include the five operating bands of GSM850/900/1800/1900/UMTS and also reduce the occupied area of the antenna.

Therefore, it is necessary to provide a dual-band mobile communication device and an antenna structure thereof, which will eliminate the problems encountered by prior technologies.

SUMMARY OF THE INVENTION

The main objective of the present invention is to provide a dual-band mobile communication device which can achieve GSM/UMTS multiband operation.

Another objective of the present invention is to provide an antenna structure of a dual-band mobile communication device which can achieve GSM/UMTS multiband operation.

To achieve the above objectives, the dual-band mobile communication device of the present invention includes a ground plane and an antenna. The antenna is located on the dielectric substrate near the ground plane, and the antenna has a first frequency band and a second frequency band. The antenna comprises a feeding portion and a shorted radiating portion. The length of the feeding portion is essentially one quarter-wavelength of the center frequency in the second frequency band. One end of the feeding portion is an antenna feeding point, and the feeding portion generates the second frequency band.

A length of the shorted radiating portion is at least twice the length of the feeding portion, and the length of the shorted radiating portion is essentially one quarter-wavelength of the center frequency in the first frequency band. A first end of the shorted radiating portion is the shorting end and is electrically connected to the ground plane.

A second end of the shorted radiating portion is an open end, and the shorted radiating portion includes multiple bendings. The open end of the shorted radiating portion extends towards a first fractional section in the shorting end of the shorted radiating portion. At the same time, a coupling gap exists between a second fractional section of the open end of the shorted radiating portion and the feeding portion. Through the coupling gap, the shorted radiating portion is capacitively excited by the feeding portion to generate the first frequency band.

To achieve the other objective, the antenna structure of the present invention includes a dielectric substrate, a ground plane, and an antenna. The antenna is located on the dielectric substrate near the ground plane, and the antenna has a first frequency band and a second frequency band.

The antenna includes a feeding portion and a shorted radiation portion. One end of the feeding portion is the feeding point of the antenna, and the feeding portion generates a second frequency band.

A first end of the shorted radiating portion is the shorting end and is electrically connected to the ground plane, and a second end of the shorted radiating portion is the open end. The shorted radiating portion includes multiple bendings, which form multiple fractional sections.

The open end of the shorted radiating portion extends towards a first fractional section in the shorting end of the shorted radiating portion. A coupling gap exists between a second fractional section of the open end of the shorted radiating portion and the feeding portion. The shorted radiating portion is capacitively excited by the feeding portion to generate the first frequency band.

DETAILED DESCRIPTION OF THE PREFERRED EMBODIMENTS

The advantages and innovative features of the invention will become more apparent from the following preferred embodiments.

Figure 1:
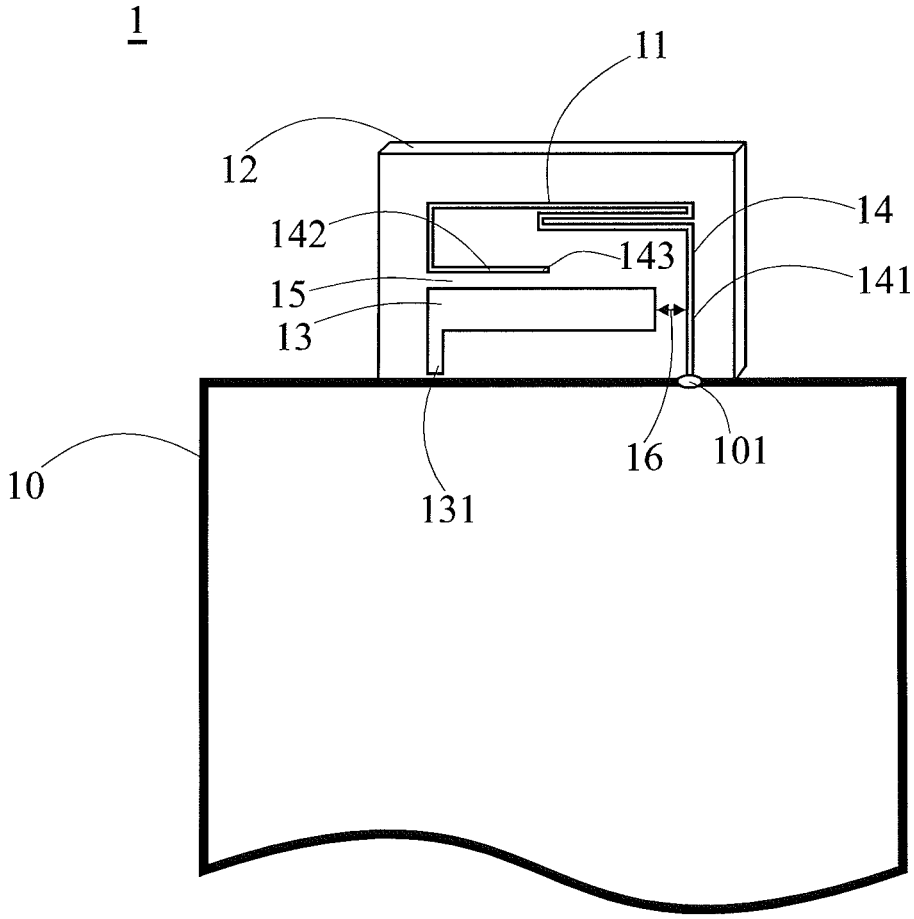
FIG. 1 shows a structural diagram of the first embodiment of the present invention for a dual-band mobile communication device together with its antenna structure.

FIG. 1 is the structural diagram of the first embodiment of the dual-band mobile communication device and its antenna structure. The dual-band mobile communication device 1 includes an antenna structure, and the antenna structure includes a ground plane 10, a dielectric substrate 12, and an antenna 11.

Figure 2:
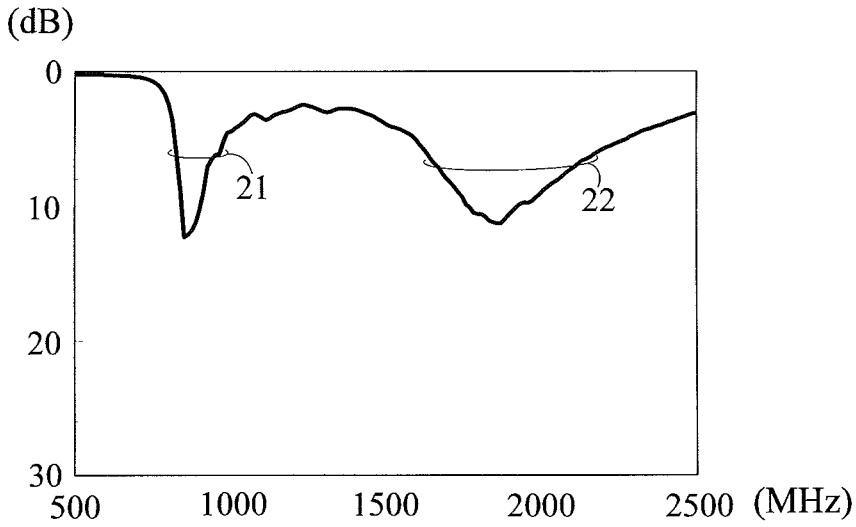
FIG. 2 shows a diagram of the measured return loss measurement for the first embodiment of the present invention.

For example, the ground plane 10 can be a system ground plane for a mobile communication device, or a system ground plane for a mobile communication handset. Antenna 11 is located on the dielectric substrate 12 near the ground plane 10, and the antenna 11 has a first frequency band 21 and a second frequency band 22 (as shown in FIG. 2).

As shown in FIG. 1, the antenna 11 includes a feeding portion 13 and a shorted radiation portion 14. Please note that a length of the feeding portion 13 is about one quarter-wavelength of a center frequency of the second frequency band 22 of the antenna 11. In other words, the feeding portion 13 is used for generating the second frequency band 22, and the second frequency band 22 covers at least 1710~2170 MHz. From FIG. 1, it can be seen that the feeding portion 13 has a first end and a second end, and the first end of the feeding portion 13 is a feeding point 131 of the antenna 11.

Furthermore, a length of the shorted radiating portion 14 is at least twice the length of the feeding portion 13, and the length of the shorted radiating portion 14 is about one quarter-wavelength of the center frequency of the first frequency band 21 of the antenna 11. A first end of the shorted radiating portion 14 is the shorting end 101, and it is electrically connected to the ground plane 10. A second end of the shorted radiating portion 14 is the open end 143.

The shorted radiating portion 14 includes multiple bendings. In the preferred embodiment, the shorted radiating portion 14 has seven bendings, thus dividing the shorted radiating portion 14 into multiple fractional sections (including 141 and 142). Please note that the open end 143 of the shorted radiating portion 14 extends toward the fractional section 141 in the shorting end of the shorted radiating portion. The distance 16 between the feeding portion 13 and the fractional section 141 in the shorting end must be less than 10 mm. At the same time, the distance of the coupling gap 15 between the feeding portion 13 and the fractional section 142 of the open end of the shorted radiating portion must be less than 3 mm.

Therefore, via the coupling gap 15, the shorted radiating portion 14 can be capacitively excited by the feeding portion 13. In other words, the shorted radiating portion 14 is used for generating a first frequency band 21, and the first frequency band 21 covers at least 824~960 MHz.

FIG. 2 shows the diagram of the measured return loss for the first embodiment of the present invention. The horizontal axis represents the operating frequency, and the vertical axis represents the return loss.

In the first embodiment, the following dimensions were chosen for the experiment: the length and width of the ground plane 10 are approximately 100 mm and 40 mm; the occupied area of the antenna 11 is approximately 25×15 mm2 ; the dielectric substrate 12 has a length of 25 mm, a width of 15 mm, a thickness of 0.8 mm and a relative permittivity of 4.4; the feeding portion 13 has a length of 22.5 mm and a width of 3.5 mm; and the shorted radiating portion 14 has a length of 85 mm and a width of 0.5 mm.

As shown in FIG. 2, the first embodiment of the present invention can generate the first frequency band 21 and the second frequency band 22. Under the 3:1 VSWR return loss definition (general specification of the antenna design for mobile communication devices), at least 824~960 MHz and 1710~2170 MHz must be covered. The two operating bands can cover the penta-band WWAN (wireless wide area network) operation, which includes the GSM850/900 (824~960 MHz) dual-band operation and the GSM1800/1900/UMTS (1710~2170MHz) tri-band operation.

Figure 3:
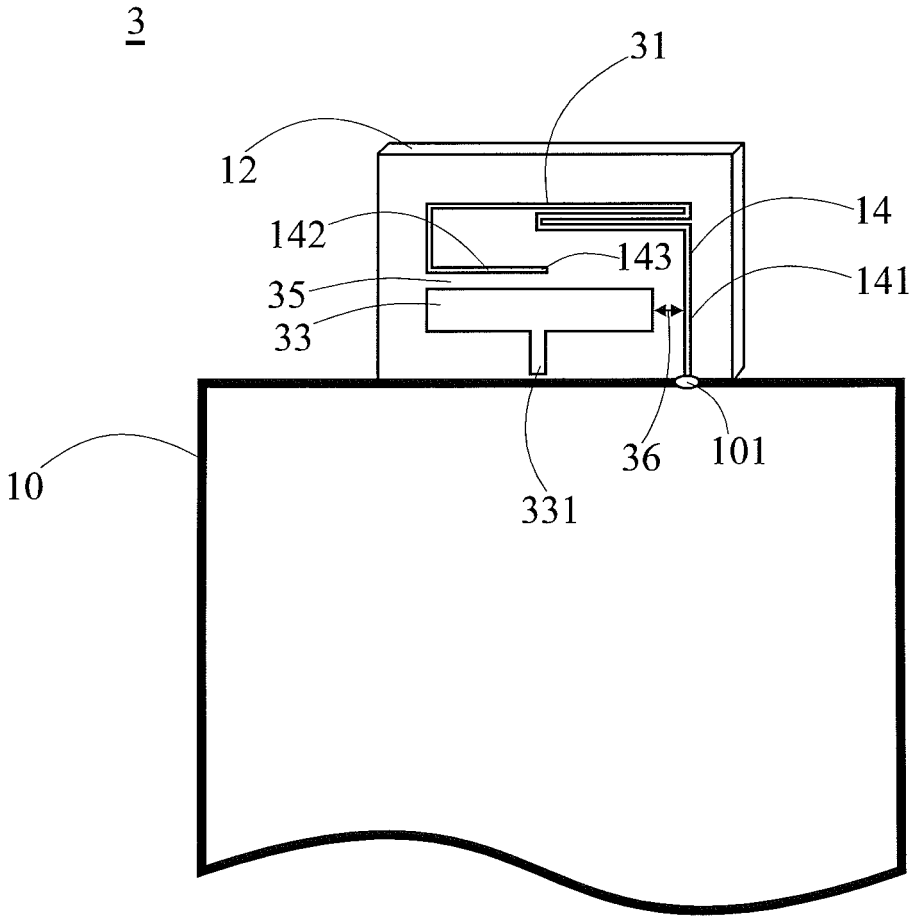
FIG. 3 shows a structural diagram of the second embodiment of the present invention for a dual-band mobile communication device together with its antenna structure.

FIG. 3 shows the structural diagram of the second embodiment of the present invention for a dual-band mobile communication device together with its antenna structure. The dual-band mobile communication device 3 includes an antenna structure, and the antenna structure includes a ground plane 10, a dielectric substrate 12, and an antenna 31. The antenna 31 is located on the dielectric substrate 12, and the antenna 31 includes a feeding portion 33 having a feeding element 331 and a shorted radiating portion 14. There is a coupling gap 35 between the feeding portion 33 and the fractional section 142 and a distance 36 between the feeding portion 33 and the fractional section 141.

The basic structure of the second embodiment is similar to that of the first embodiment. The major difference is that the feeding portion 33 of the second embodiment is a T-shaped metal plate, whereas the feeding portion 13 of the first embodiment is an L-shaped metal plate.

Even though the shape of the feeding portion 33 is slightly changed in the second embodiment, the second frequency band 22 can still be generated by adjusting the dimensions of the feeding portion 33. The shorted radiating portion 14 can be capacitively excited by the feeding portion 33 to generate the first frequency band 21, thereby yielding a result similar to that in the first embodiment.

Figure 4:
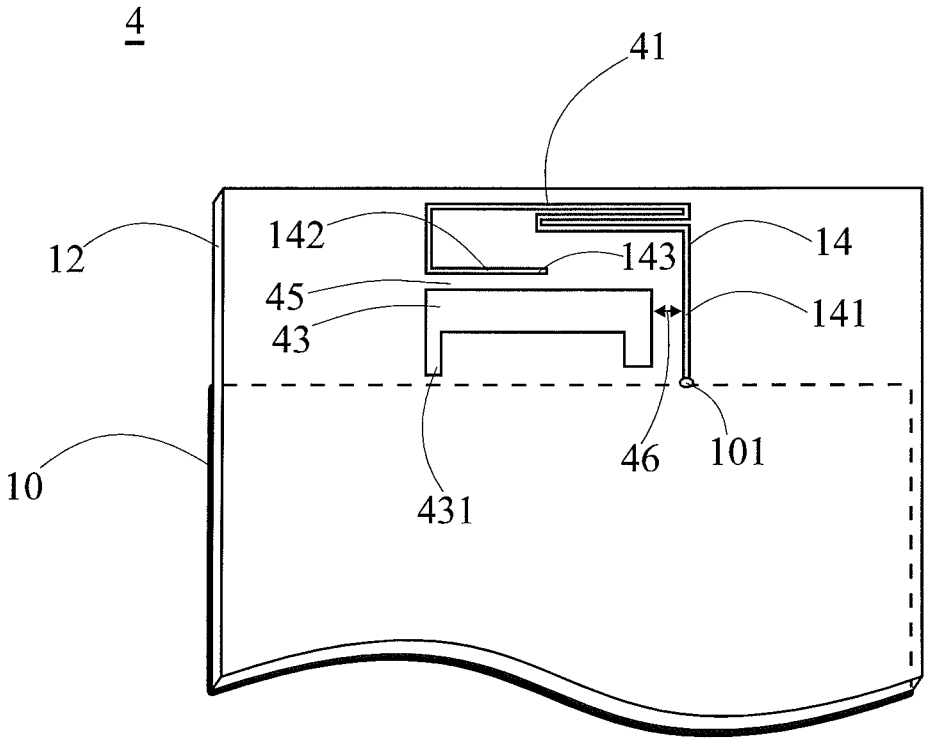
FIG. 4 shows a structural diagram of the third embodiment of the present invention for a dual-band mobile communication device together with its antenna structure.

FIG. 4 shows the structural diagram of the third embodiment of the present invention for a dual-band mobile communication device together with its antenna structure. The dual-band mobile communication device 4 includes an antenna structure, and the antenna structure comprises a ground plane 10, a dielectric substrate 12, and an antenna 41. The antenna 41 is located on the dielectric substrate 12, and the antenna 41 includes a feeding portion 43 having a feeding element 431 and a shorted radiating portion 14. There is a coupling gap 45 between the feeding portion 43 and the fractional section 142 and a distance 46 between the feeding portion 43 and the fractional section 141.

The basic structure of the third embodiment is similar to that of the first embodiment. The major difference is that the feeding portion 43 of the third embodiment is an inverted U-shaped metal plate. Even though the shape of the feeding portion 43 has been changed in the third embodiment, the second frequency band 22 can still be achieved by adjusting the dimensions of the feeding portion 43. The shorted radiating portion 14 can be capacitively excited by the feeding portion 43 to generate the first frequency band 21, thereby yielding a result similar to that in the first embodiment.

In summary, the dual-band mobile communication device of the present invention utilizes a feeding portion to generate a second frequency band, which covers the GSM1800/1900/UMTS tri-band operation. The shorted radiating portion has multiple bendings, which form multiple fractional sections, causing the second fractional section at the open end of the shorted radiating portion to extend towards the fractional section at the shorting end of the shorted radiating portion. A coupling gap exists between the feeding portion and the shorted radiating portion.

As a result, with the presence of the coupling gap, the feeding portion is able to capacitively excite the shorted radiating portion. The shorted radiating portion can generate a first frequency band, because the length of the shorted radiating portion is at least twice the length of the feeding portion, and the first frequency covers the GSM850/900 dual-band operation.

Through the first frequency band and the second frequency band generated by the feeding portion and the shorted radiating portion, as well as the open end extending towards the first fractional section at the shorting end of the shorted radiating portion, the antenna can fully cover the five-band WWAN operation. Furthermore, the multiple bendings of the shorted radiating portion decrease the length of the antenna along an edge of a mobile communication device, thereby achieving the objective of reducing the occupied area of the antenna.

Although the present invention has been explained in relation to its preferred embodiments, it is also of vital importance to acknowledge that many other possible modifications and variations can be made without departing from the spirit and scope of the invention as hereinafter claimed.

What is claimed is:

1. A dual-band mobile communication device, comprising a ground plane and an antenna, the antenna being located on a dielectric substrate close to the ground plane, and the antenna having a first frequency band and a second frequency band, the antenna comprising:

a feeding portion comprising a first end and a second end, wherein the second end is an open end, wherein a length of the feeding portion is essentially one quarter-wavelength of a center frequency of the second frequency band, wherein the first end of the feeding portion is a feeding point of the antenna, and wherein the feeding portion generates the second frequency band; and a shorted radiating portion, wherein a length of the shorted radiating portion is at least twice the length of the feeding portion, wherein the length of the shorted radiating portion is essentially one quarter-wavelength of the a center frequency of the first frequency band; wherein a first end of the shorted radiating portion is shorted to the ground plane, wherein a second end of the shorted radiating portion is an open end, wherein the shorted radiating portion comprises a first linear section terminating in the second end, with the first linear section extending in a first linear direction towards the second end of the shorted radiating portion; wherein the feeding portion comprises a second linear section terminating in the second end of the feeding portion, with the second linear portion extending in a second linear direction towards the second end of the feeding portion; wherein the shorted radiating portion comprises multiple bends, wherein the first linear direction essentially extends parallel to, alongside, and in a same direction as the second linear direction; wherein the second linear section is between the ground plane and the first linear section, wherein the first linear section and the second linear section are parallel to the ground plane; wherein a coupling gap exists between the first linear section and the second linear section; and wherein the shorted radiating portion is capacitively excited by the feeding portion to generate the first frequency band.

2. The dual-band mobile communication device as claimed in claim 1, wherein the coupling gap is less than 3 mm.

3. The dual-band mobile communication device as claimed in claim 1, wherein the first linear section has a length in the first linear section greater than or equal to 5 mm.

4. The dual-band mobile communication device as claimed in claim 1, wherein the feeding portion is an L-shape, a T-shape, or an inverted U-shape.

5. The dual-band mobile communication device as claimed in claim 1, wherein the first frequency band covers at least 824~960 MHz, and wherein the second frequency band covers at least 1710~2170 MHz.

6. The dual-band mobile communication device as claimed in claim 1, wherein the coupling gap between the first linear section and the second linear section is less than 10 mm.

7. An antenna structure, comprising:

a ground plane;

a dielectric substrate; and an antenna, located on the dielectric substrate close to the ground plane, with the antenna having a first frequency band and a second frequency band; the antenna comprising:

a feeding portion comprising a first end and a second end, wherein the second end is an open end, wherein the first end of the feeding portion is a feeding portion of the antenna, and wherein the feeding portion generates the second frequency band; and a shorted radiating portion, wherein a first end of the shorted radiating portion is shorted to the ground plane and a second end of the shorted radiating portion is an open end; wherein the shorted radiating portion comprises multiple bends forming a first linear section terminating in the second end of the shorted radiating portion, with the first linear section extending in a first linear direction towards the second end of the shorted radiating portion; wherein the feeding portion comprises a second linear section terminating in the second end of the feeding portion, with the second linear portion extending in a second linear direction towards the second end of the feeding portion; wherein the first linear direction essentially extends parallel to, alongside, and in a same direction as the second linear direction; wherein the second linear section is between the ground plane and the first linear section, wherein the first linear section and the second linear section are parallel to the ground plane; wherein a coupling gap exists between the first linear section and the second linear section; and wherein the shorted radiating portion is capacitively excited by the feeding portion to generate the first frequency band.

8. The antenna structure as claimed in claim 7, wherein a length of the feeding portion is essentially one quarter-wavelength of a center frequency in the second frequency band; a length of the shorted radiating portion must be at least twice the length of the feeding portion, and the length of the shorted radiating portion is essentially one quarter-wavelength of a center frequency in the first frequency band.

9. The antenna structure as claimed in claim 7, wherein the coupling gap is less than 3 mm.

10. The antenna structure as claimed in claim 7, wherein the first linear section has a length in the first linear section greater than or equal to 5 mm.

11. The antenna structure as claimed in claim 7, wherein the feeding portion is an L-shape, a T-shape, or an inverted U-shape.

12. The antenna structure as claimed in claim 7, wherein the first frequency band covers at least 824~960 MHz, and the second frequency band covers at least 1710~2170 MHz.

13. The antenna structure as claimed in claim 7, wherein the coupling gap between the first linear section and the second linear section is less than 10 mm.

* * * * *